US006607222B2

(12) United States Patent
Inoue

(10) Patent No.: US 6,607,222 B2
(45) Date of Patent: Aug. 19, 2003

(54) VEHICLE DOOR LATCH DEVICE WITH ONE-MOTION DOOR OPENING MECHANISM AND ANTITHEFT MECHANISM

(75) Inventor: Jiro Inoue, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,397

(22) Filed: Dec. 28, 2000

(65) Prior Publication Data

US 2001/0005080 A1 Jun. 28, 2001

(30) Foreign Application Priority Data

Dec. 28, 1999 (JP) ..... 11-373264

(51) Int. Cl.[7] ..... E05C 3/06
(52) U.S. Cl. ..... 292/216; 292/201; 292/DIG. 23
(58) Field of Search ..... 292/201, 216, 292/DIG. 23

(56) References Cited

U.S. PATENT DOCUMENTS

| | | | | | |
|---|---|---|---|---|---|
| 4,342,209 | A | * | 8/1982 | Kleefeldt | 70/264 |
| 4,364,249 | A | * | 12/1982 | Kleefeldt | 70/264 |
| 4,763,936 | A | * | 8/1988 | Rogakos et al. | 292/201 |
| 4,974,886 | A | * | 12/1990 | Kleefeldt et al. | 292/201 |
| 5,066,054 | A | * | 11/1991 | Ingenhoven | 292/201 |
| 5,071,178 | A | * | 12/1991 | Brackman et al. | 292/216 |
| 5,181,754 | A | * | 1/1993 | Shibata | 292/216 |
| 5,238,274 | A | * | 8/1993 | Becker et al. | 292/201 |
| 5,419,597 | A | | 5/1995 | Brackmann et al. | |
| 5,427,421 | A | * | 6/1995 | Hamaguchi | 292/216 |
| 5,531,488 | A | * | 7/1996 | Yoshikuwa et al. | 292/216 |
| 5,538,298 | A | | 7/1996 | Ikeda | |
| 5,582,448 | A | * | 12/1996 | Inoue | 292/336.3 |
| 5,603,537 | A | * | 2/1997 | Amano et al. | 292/201 |
| 5,615,564 | A | * | 4/1997 | Inoue | 70/279 |
| 5,656,899 | A | * | 8/1997 | Kuroda | 318/283 |
| 5,680,783 | A | * | 10/1997 | Kuroda | 70/277 |
| 5,709,420 | A | * | 1/1998 | Umino | 292/216 |
| 5,802,894 | A | * | 9/1998 | Jahrsetz et al. | 70/264 |
| 5,833,282 | A | * | 11/1998 | Ikeda | 292/201 |
| 5,865,481 | A | * | 2/1999 | Buschmann | 292/216 |
| 5,896,767 | A | * | 4/1999 | Gomi | 70/237 |
| 5,961,164 | A | * | 10/1999 | Gomi | 292/216 |
| 6,065,315 | A | * | 5/2000 | Hoshikawa et al. | 70/264 |
| 6,109,079 | A | * | 8/2000 | Ikeda | 70/264 |
| 6,168,216 | B1 | * | 1/2001 | Nakajima et al. | 292/201 |
| 6,189,940 | B1 | * | 2/2001 | Hayakawa et al. | 292/216 |
| 6,321,488 | B1 | * | 11/2001 | Bigoszewski et al. | 49/358 |
| 6,343,817 | B1 | * | 2/2002 | Watanabe | 292/216 |
| 6,371,538 | B1 | * | 4/2002 | Inoue | 292/216 |

FOREIGN PATENT DOCUMENTS

| | | |
|---|---|---|
| GB | 2 349 171 | 10/2000 |
| GB | 2 350 644 | 12/2000 |

* cited by examiner

*Primary Examiner*—Robert J. Sandy
*Assistant Examiner*—Carlos Lugo
(74) *Attorney, Agent, or Firm*—Browdy and Neimark, P.L.L.C.

(57) ABSTRACT

A vehicle door latch device comprises a one-motion door opening mechanism transmitting an opening movement of an inside open handle both to a lock lever and to a ratchet, an free-play type antitheft member, and a clutch mechanism provided between the one-motion mechanism and the inside open handle. The clutch mechanism is so connected to the antitheft member that the clutch mechanism is displaced to an uncoupling state where it does not transmit the opening movement to the one-motion mechanism when the antitheft member is changed over to a antitheft position, and that the clutch mechanism is displaced to a coupling state where it transmits the opening movement to the one-motion mechanism when the antitheft member is changed over to an antitheft cancelled position.

3 Claims, 5 Drawing Sheets

18
1
25
5
7
18A
22
26
19
8
35
35B
16
20
35A
35D
37
18A
31
CLUTCH MECHANISM
21
33
39
32
35C
U
43
27
L
44
41
34
24
23
48
28
75
38
EXTERIOR SIDE
INTERIOR SIDE

VEHICLE DOOR LATCH DEVICE WITH ONE-MOTION DOOR OPENING MECHANISM AND ANTITHEFT MECHANISM

TECHNICAL FIELD

The present invention relates to a vehicle door latch device, and more particularly to a vehicle door latch device provided with a one-motion door opening mechanism and an antitheft mechanism.

BACKGROUND OF THE INVENTION

A conventional vehicle door latch device is provided with a lock lever which is displaceable, by an unlocking operation and a locking operation of an inside lock button of the door, between an unlocked position where an opening operation of an outside open handle of the door is transmitted to a ratchet so as to open the door and a locked position where the opening operation of the outside open handle is not transmitted to the ratchet. Because the inside lock button to which the lock lever should be connected is disposed on an interior surface of the door in the exposed state, an antitheft performance of the lock button is not so high. For example, it is quite easy to operate the lock button by breaking a door glass from outside the vehicle to illegally change the lock lever to the unlocked position. To invalidate such an illegal access to the lock button, a number of antitheft mechanisms have been developed.

The typical antitheft mechanism has a free-play mechanism provided between the inside lock button and the lock lever (e.g., U.S. Pat. No. 5,538,298). The free-play mechanism can absorb an unlocking movement of the lock button so as not to transmit the unlocking movement to the lock lever. That is, no external force is applied to the lock lever even if the lock button is operated to unlock illegally. This free-play type antitheft mechanism effectively invalidates the illegal access to the inside lock button.

The prior art free-play type antitheft mechanism has a disadvantage that it cannot easily be combined with the well known one-motion door opening mechanism which carries out restoration of the lock lever from the locked position to the unlocked position and opening of the door substantially at the same time, by the opening operation of the inside open handle. The one-motion door opening mechanism transmits an opening movement of the inside open handle to the lock lever located in the locked position in order to return the lock lever to the unlocked position. Due to this mechanism, even if the inside lock button is protected by the antitheft mechanism, the illegal access can unlock the lock lever easily.

SUMMARY OF THE INVENTION

Accordingly, it is an object of the present invention to provide a vehicle door latch device with addition of a free-play type antitheft mechanism and a one-motion door opening mechanism by overcoming the above mentioned disadvantage.

DESCRIPTION OF THE PREFERRED EMBODIMENTS

Figure 1:
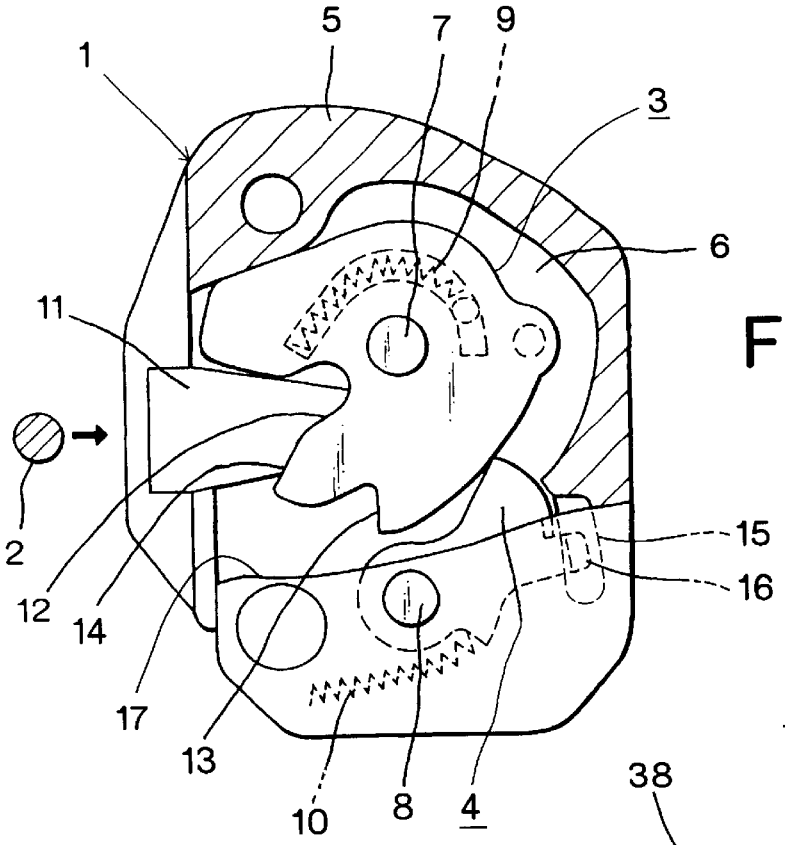
FIG. 1 is a front view of a latch assembly of a door latch device according to the present invention.

Referring to FIG. 1, a vehicle door latch device in accordance with the present invention comprises a latch assembly 1 which is attached to a vehicle door (not shown) and a striker 2 which is fixed to a vehicle body (not shown). The latch assembly 1 has a latch 3 which is engaged with the striker 2 when the door is closed, and a ratchet 4 which holds the engagement between the latch 3 and the striker 2. The latch 3 is rotatably received by a latch shaft 7 in a recess 6 formed in the front surface of a synthetic resin latch body 5, and the ratchet 4 is rotatably received in the recess 6 by a ratchet shaft 8.

The latch 3 is urged clockwise in FIG. 1 by a spring force of the latch spring 9. When the door is in an open position, the latch 3 is located in an unlatched position or open position as shown in FIG. 1 by the spring force of the latch spring 9. The ratchet 4 is urged counterclockwise by a spring force of a ratchet spring 10 to be brought into contact with the latch 3. When the door is moved toward a full-closed position, the striker 2 enters a horizontal passage 11 formed in the latch body 5 to be brought into contact with a U-shaped groove 12 of the latch 3, and the latch 3 is then rotated counterclockwise against the latch spring 9. When the latch 3 is rotated up to a half-latched position, the ratchet 4 is engaged with a first step 13 of the latch 3 and the door reaches a half-closed position. Further, when the latch 3 comes to a full-latched position, the ratchet 4 is engaged with a second step 14 of the latch 3 and the door is held in the full-closed position.

The ratchet 4 has a ratchet pin 16 projecting onto the rear side of the latch body 5 through an opening 15 of the latch body 5. To the front surface of the latch body 5, a metal cover plate 17 for covering the recess 6 is fixed. The cover plate 17 is partially shown in FIG. 1.

Figure 4:
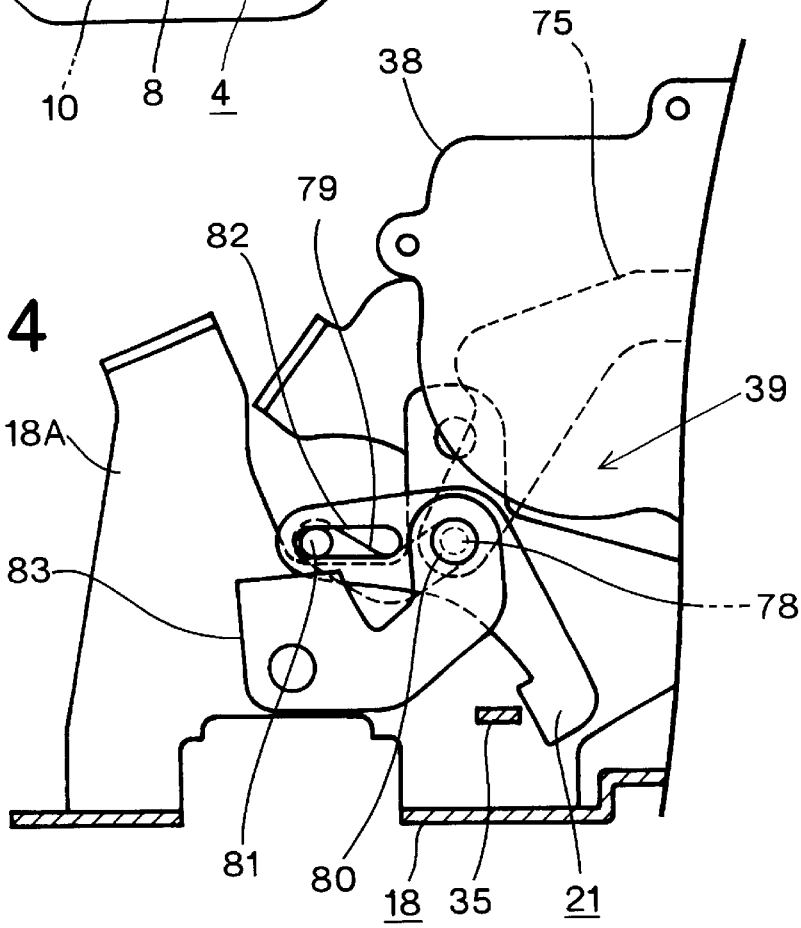
FIG. 4 is a side view an exterior side of a bent plate of the latch assembly and parts mounted on the bent plate.
Figure 2:
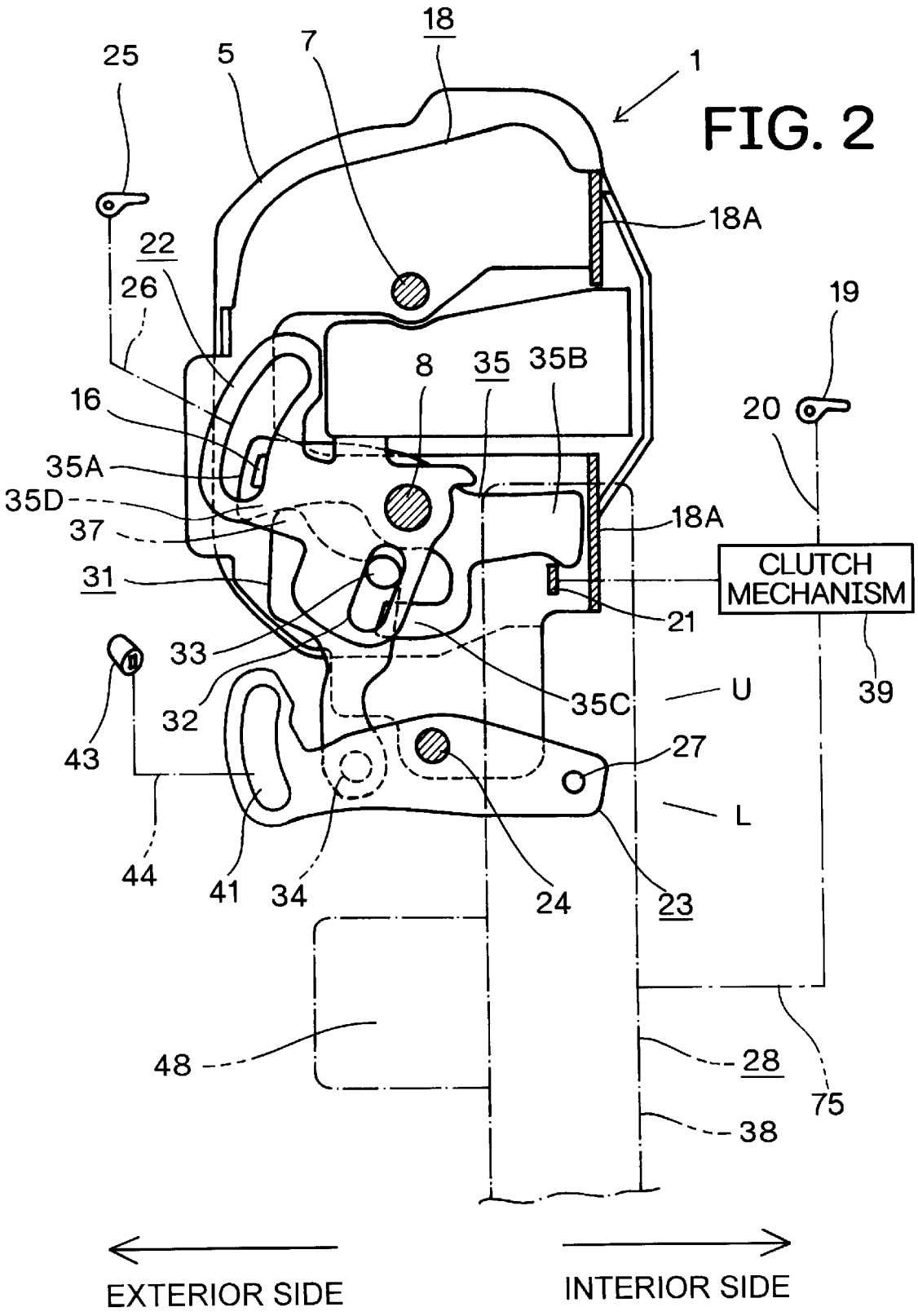
FIG. 2 is a rear view of the latch assembly in a locked state.

To the rear portion of the latch body 5, as shown FIG. 2, a metal back plate 18 is fixed. The back plate 18 has a bent plate 18A which is bent to extend rearward from an interior side edge thereof. To the bent plate 18A, there is rotatably fitted an inner lever 21 (FIGS. 3 and 4) which is connected to a door inside open handle 19 through a clutch mechanism 39 and a wire cable 20.

The latch assembly 1 further has an open lever 22 for releasing the ratchet 4 from the latch 3 so as to open the door, and a lock lever 23 for changing over the latch assembly 1 between a locked state and an unlocked state. The open lever 22 is rotatably attached to the rear portion of the latch body 5 by the ratchet shaft 8. An exterior side end of the open lever 22 is connected to an outside open handle 25 of the door by way of a rod 26 with a lost motion. The lock lever 23 is rotatably attached to the latch body 5 or the back plate 18 by a lock shaft 24. The lock lever 23 has, at an interior side end thereof, a connection hole 27 for connection with a motorized actuator 28 with a free-play type antitheft mechanism, and has, at an exterior side end thereof, a slot 41 connected to a key cylinder 43 of the door by way of a rod 44.

A lock link 31 is provided between the lock lever 23 and the open lever 21. The lock link 31 has a lock pin 33 which is slidably engaged with a slot 32 formed on the open lever 22. The lock link 31 is connected with the lock lever 23 by a shaft 34.

A ratchet lever 35 is rotatably mounted on the ratchet shaft 8. The ratchet lever 35 is located between the latch body 5 and the open lever 22. An outer arm 35A of the ratchet lever 35 extending to the exterior side the door, is engaged with the ratchet pin 16 which extends rearward from the ratchet 4, so that the ratchet lever 35 is rotated integrally with the ratchet 4 as one piece. An inner arm 35B of the ratchet lever 35 extending to the interior side of the door, is located on the locus of rotation of the inner lever 21. When the inner lever 21 is rotated by the door opening operation of the inside open handle 19, the ratchet lever 35 is rotated counterclockwise in FIG. 2 due to the contact with the inner lever 21, and then the ratchet 4 is rotated to be released from the latch 3, thereby the door is opened.

The actuator 28 provided with the free-play type antitheft mechanism is fixed to the bent plate 18A. An output shaft 29 of the actuator 28 fixedly supports an output lever 30 which is engaged with the connection hole 27 of the lock lever 23.

Figure 3:
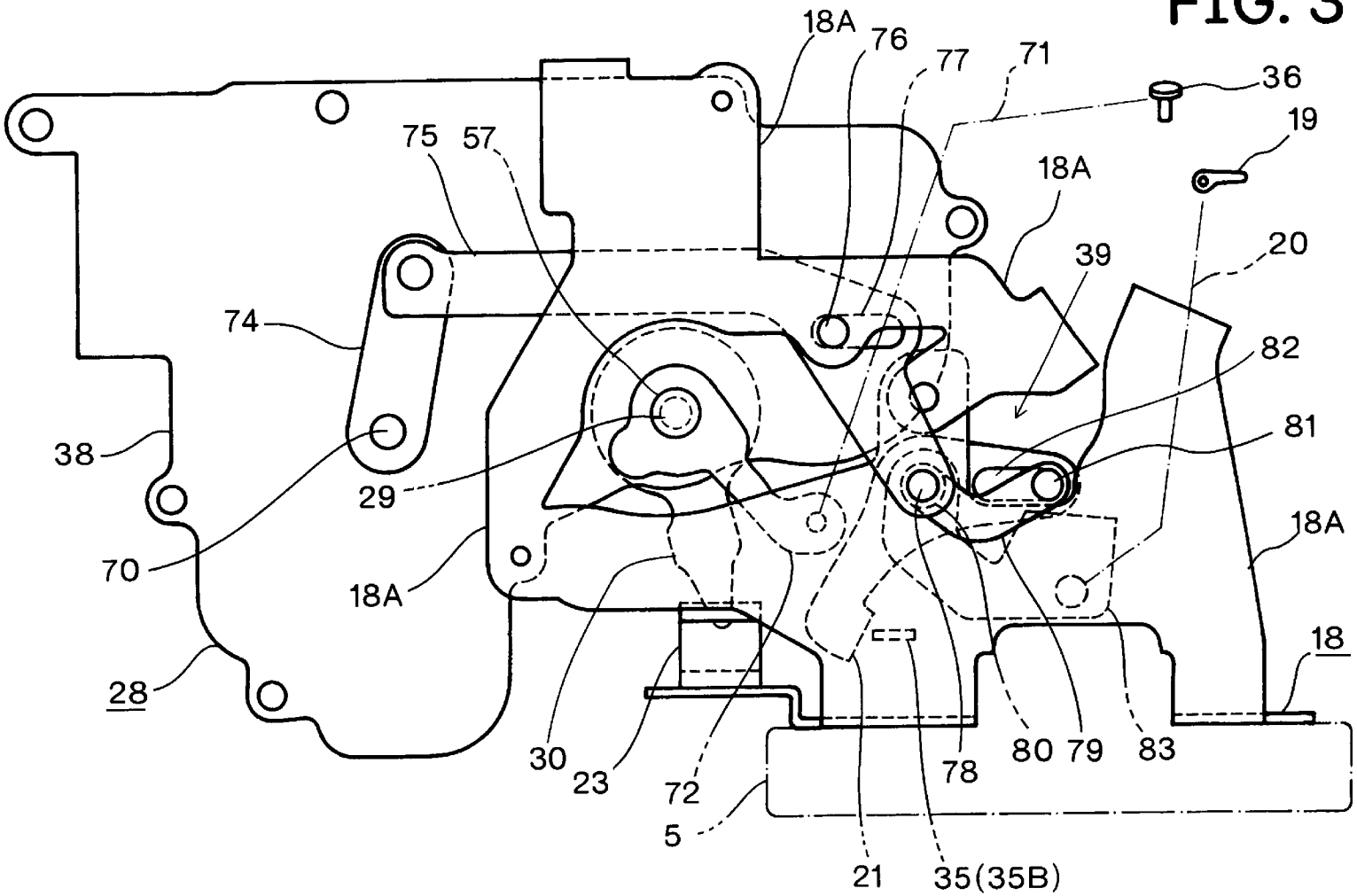
FIG. 3 is a side view showing an interior side of the latch assembly.

The lock lever 23 is displaceable between an unlocked position U and a locked position L (FIG. 2) by the actuation of one of the actuator 28, the door key cylinder 43, and a well known door inside lock button 36 (FIG. 3). When the lock lever 23 is displaced to the unlocked position U, the lock pin 33 is moved downward within the slot 32 to be engageably opposed with a contact portion 35C of the ratchet lever 35. In this unlocked state, when the open lever 22 is rotated counterclockwise by the opening operation of the outside open handle 25, the lock pin 33 comes into contact with the contact portion 35C to rotate the ratchet lever 35 counterclockwise, thereby the door is opened.

When the lock lever 23 is in the locked position L as shown in FIG. 2, the engageable state of the lock pin 33 with the contact portion 35C is cancelled. In this locked state, the counterclockwise rotation of the open lever 22 by the outside open handle 25 cannot rotate the ratchet lever 35. However, when the inside open handle 19 is operated to open the door, the inner lever 21 comes into contact with the inner arm 35B to rotate the ratchet lever 35, thereby the door is opened. Thus, the door opening operation of the inside open handle 19 is effective even if the lock lever 23 is in the locked position L.

The lock link 31 has a projecting portion 37 which extends toward a lower surface 35D of the outer arm 35A of the ratchet lever 35. The projecting portion 37 is located in the vicinity of the lower surface 35D in the locked state of FIG. 2. Therefore, when the ratchet lever 35 is rotated counterclockwise by the opening operation of the inside open handle 19 in the locked state, the lower surface 35D comes into contact with the projecting portion 37 to cause the lock link 31 to move downward, thereby the lock lever 23 is returned to the unlocked position U. In this manner, the opening operation of the inside open handle 19 in the locked state is approximately simultaneously capable of restoring the lock lever 23 from the locked position L to the unlocked position U and opening the door. This mechanism is called a one-motion door opening mechanism of the inside open handle 19.

Figure 5:
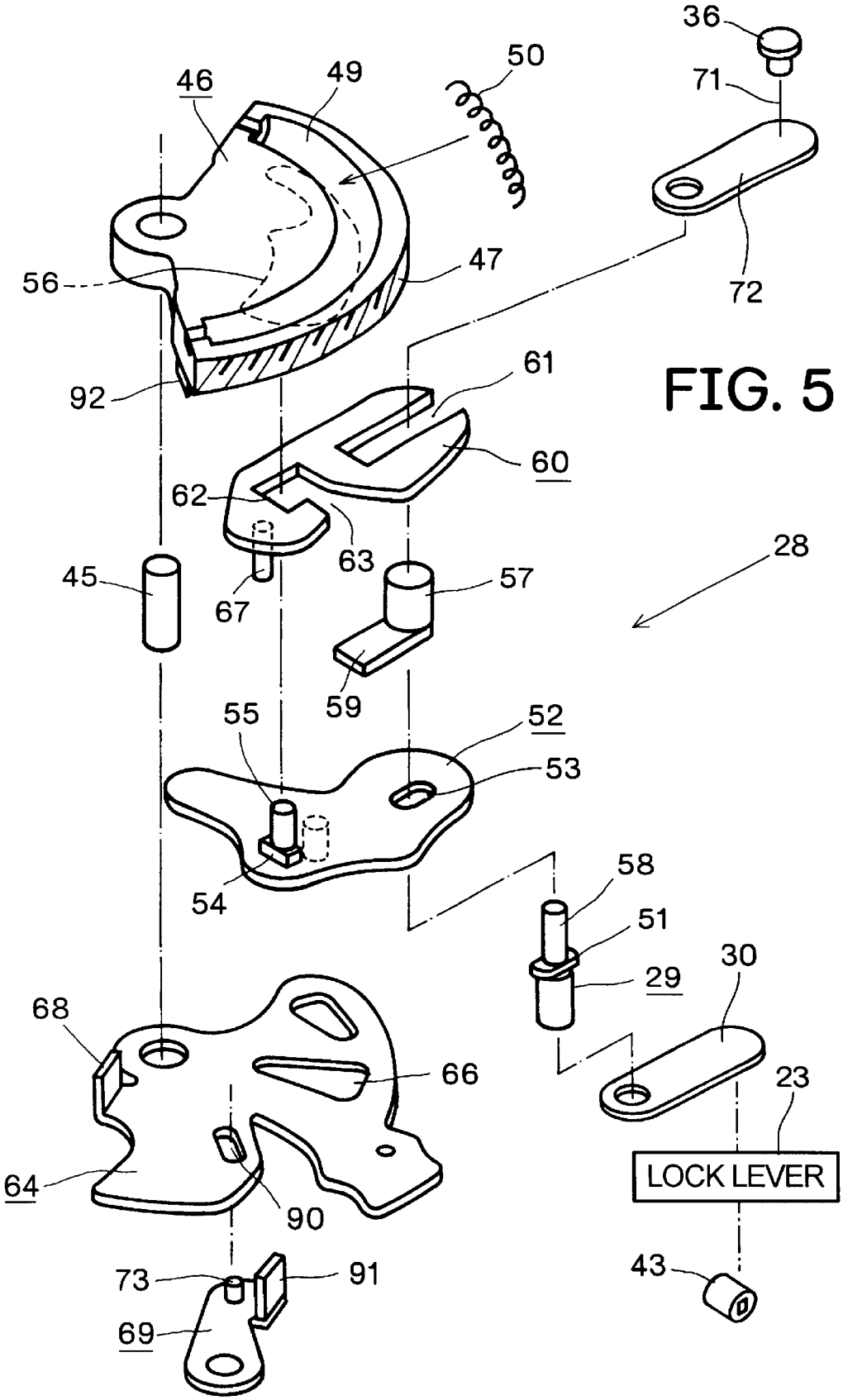
FIG. 5 is an exploded perspective view of an actuator with a free-play type antitheft mechanism.

The output shaft 29 of the actuator 28 projects toward the exterior side from an actuator case 38. The output lever 30 is fixed to the projecting portion of the output shaft 29. The actuator 28 is provided with substantially the same constitution as an actuator described in U.S. Pat. No. 5,538,298. Accordingly, the structure of the actuator is only briefly described with reference to FIGS. 5 to 7. In the case 38, a sector-shaped output member 46 is rotatably received by a center shaft 45. A gear part 47 formed on the outer periphery of the output member 46 is meshed with a motor gear (not shown) of the motor 48 (FIG. 2). The output member 46 has an arc groove 49 in which a return spring 50 for returning the output member 46 to a neutral position is received.

The output shaft 29 provided near the output member 46 has an oval part 51 which is engaged with an oval hole 53 of a first lever 52 which is displaced integrally with the lock lever 23 through the output shaft 29 and the output lever 30. A box-shaped engaging part 54 of the first lever 52 is engageable with a hook 62 of an antitheft member 60, and a pole 55 of the first lever 52 is located in a cam recess 56 formed on the lower surface of the output member 46.

A small diameter shaft 58 formed on an upper part of the output shaft 29 is rotatably inserted into a hollow shaft 57. One end of the hollow shaft 57 projects outward from the case 38 to support a sub lever 72 which is located outside the case 38. The sub lever 72 is connected with the inside lock button 36 through a rod 71. The hollow shaft 57 is formed integrally with a second lever 59 which projects in a radial direction of the shaft 57. The second lever 59 is slidably engaged with a forked portion 61 of the antitheft member 60. The antitheft member 60 is rotated integrally with the second lever 59 about the hollow shaft 57 as a center.

Figure 6:
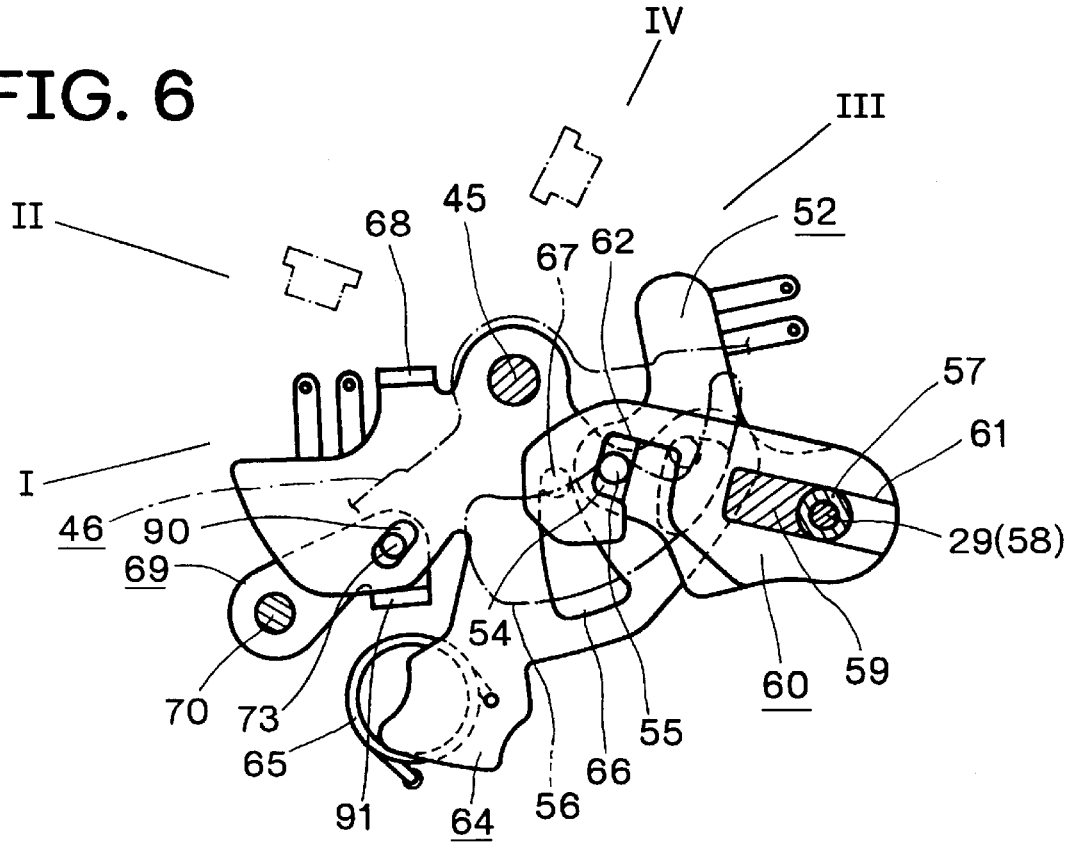
FIG. 6 is a view showing an antitheft cancelled state of the antitheft mechanism.

The hook 62 of the antitheft member 60 has an opening 63 communicating with the outside. The antitheft member 60 of FIG. 6 is in an antitheft cancelled position in which the hook 62 is engaged with the box part 54 of the first lever 52 (lock lever 23). In an antitheft cancelled state of FIG. 6, the inside lock button 36 is connected with the lock lever 23 by the engagement between the hook 62 and the box part 54.

A change-over member 64 for sliding the antitheft member 60 is rotatably mounted on the center shaft 45 underneath the first lever 52. The change-over member 64 is held in either one of a non-operating position of FIG. 6 and an operating position of FIG. 7 by a spring force of an over-center spring 65. The change-over member 64 has a triangular-shaped engaging hole 66 with which a pin 67 formed on the antitheft member 60 is engaged, and a bent portion 68 which is engageable with a side surface of the output member 46.

When the output member 46 is rotated clockwise in FIG. 6 by the motor 48 up to a lock point I, the first lever 52 (lock lever 23) is displaced to the locked position L by the contact between the cam recess 56 and the pole 55. When the output member 46 is further rotated clockwise to an antitheft point II beyond the lock point I, the change-over member 64 is rotated clockwise by the contact between the output member 46 and the bent portion 68 to be displaced to the operating position, thereby the antitheft member 60 is slid leftward by the contact between the hole 66 and the pin 67 and is displaced to the antitheft position. During this, the first lever 52 remains in the locked position L without displacement. In the antitheft state, the engagement between the hook 62 and the box part 54 is released as shown in FIG. 7, and the unlocking movement of the inside lock button 36 is not transmitted to the lock lever 23.

A release lever 69 for reinstating the change-over member 64 to the non-operating position from the operating position is fixedly mounted on an antitheft shaft 70 underneath the change-over member 64. One end of the antitheft shaft 70 is projected outward penetrating the case 38 as in FIG. 3. The release lever 69 has a pin 73 which is engaged with a slot 90 of the change-over member 64, and an engaging piece 91 which is engageable with a projecting portion 92 formed on the lower surface of the output member 46.

Figure 7:
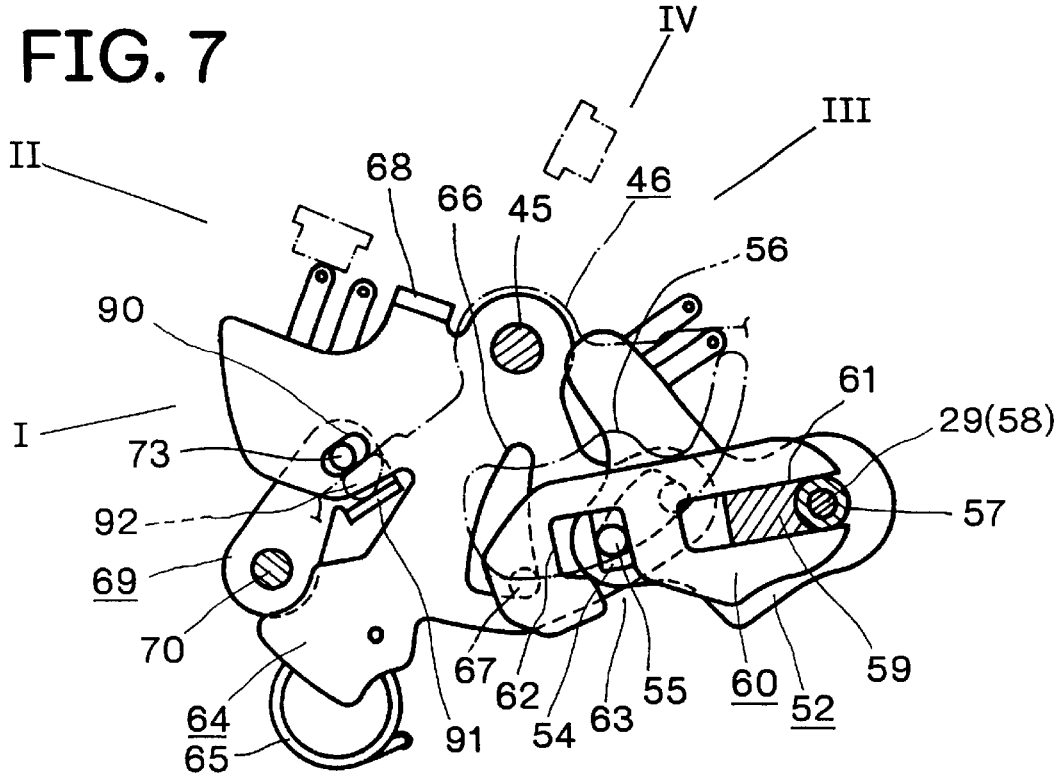
FIG. 7 is a view showing an antitheft state of the antitheft mechanism.

When the output member 46 is rotated counterclockwise from the neutral position of FIG. 7 to the antitheft cancelling point III by the motor 48, the projecting portion 92 comes into contact with the engaging piece 91 to rotate the release lever 69 clockwise about the antitheft shaft 70, and the change-over member 64 is rotated counterclockwise against the spring force of the over-center spring 65 due to the engagement of the pin 73 with the slot 90 and displaced to the non-operating position from the operating position, thereby the antitheft member 60 is moved to the antitheft cancelled position from the antitheft position. When the output member 46 is further rotated counterclockwise beyond the antitheft cancelling point III to an unlock point IV, the first lever 52 is rotated clockwise by contact between the cam recess 56 and the pole 55 to be displaced to the unlocked position.

As described above, the antitheft member 60 is changed over according to a position of the change-over member 64, and the antitheft shaft 70 is rotated according to a position of the change-over member 64. Accordingly, the antitheft shaft 70 is moved integrally with the antitheft member 60. To the projected end of the antitheft shaft 70, as shown in FIG. 3, a rotary lever 74 is fixed. An elongated connection link 75 has an end to be connected to the rotary lever 74 and the other end having a slot 77 with which a support pin 76 provided on the bent plate 18A is slidably engaged.

The clutch mechanism 39 comprises a curved link 79 connected to the other end of the connection link 75 with a connection pin 78, an engaging pin 81 formed on the curved link 79, a slot 82 formed on the inner lever 21, and an intermediate lever 83 rotatably attached to the bent plate 18A with a support shaft 80 on which the inner lever 21 is also mounted. The engaging pin 81 is slidably engaged with the slot 82, and the intermediate lever 83 is connected to the inside open handle 19 with the wire cable 20.

The connection link 75 is slid in FIG. 3 in the right-and-left direction as the antitheft shaft 70 is rotated in either direction in response to the displacement of the antitheft member 60. When the antitheft member 60 is in the antitheft cancelled position, the connection link 75 is located at a position as shown in FIG. 3, and the engaging pin 81 of the curved link 79 is engageable with the intermediate lever 83. Therefore, when the intermediate lever 83 is rotated by the door opening operation of the inside open handle 19 of the door, the inner lever 21 causes to rotate the ratchet lever 35 through the engaging pin 81. Thus, the door is opened, and the lock lever 23 is returned to the unlocked position U if the lock lever 23 is in the locked position L.

However, when displacing the antitheft member 60 to the antitheft position (at this time, the lock lever 23 is surely in the locked position L), the antitheft shaft 70 is rotated counterclockwise in FIG. 3, and the connection link 75 is then slid to the left in FIG. 3 in response to the rotation of the lever 74. As a result, the curved link 79 is also slid to the left to cancel the engageable state of the engaging pin 81 with the intermediate lever 83. Because of this, in the antitheft state, even if the intermediate lever 83 is rotated for opening door by the door opening operation of the inside open handle 19, the inner lever 21 cannot be rotated. Consequently, even if the inside open handle 19 is operated in the antitheft state, the one-motion door opening mechanism does not work, and the external force based on the door opening operation of the inside open handle 19 does not act on the lock lever 23.

What is claimed is:

1. A vehicle door latch device comprising:

a latch body to be mounted on a vehicle door;

a latch rotatably attached to the latch body and engageable with a striker fixed on a vehicle body;

a ratchet rotatably attached to the latch body and engageable with the latch to keep engagement between the latch and striker;

an inside lock button provided on the door;

a lock lever rotatably attached to the latch body and displaceable, by an unlocking operation and a locking operation of the inside lock button, between an unlocked position in which an opening movement of an outside open handle of the door is transmitted to the ratchet in order to open the door and a locked position in which the opening movement of the outside open handle is not transmitted to the ratchet;

an antitheft member displaceable between an antitheft cancelled position in which a connection state between the inside lock button and the lock lever is maintained and an antitheft position in which the connection state between the inside lock button and the lock lever is cancelled;

a one-motion door opening mechanism transmitting an opening movement of an inside open handle of the door both to the lock lever being in the locked position and to the ratchet; and a clutch mechanism displaceable between a coupling state in which the opening movement of the inside open handle is transmitted to the one-motion door opening mechanism and an uncoupling state in which the opening movement of the inside open handle is not transmitted to the one-motion opening mechanism;

wherein said clutch mechanism is so connected to said antitheft member that said clutch mechanism is displaced to the uncoupling state when said antitheft member is changed over to the antitheft position, and that said clutch mechanism is displaced to the coupling state when said antitheft member is changed over to the antitheft cancelled position.

2. A vehicle door latch according to claim 1, wherein said one-motion door opening mechanism comprises a ratchet lever which is rotated by receiving the opening movement of the inside open handle by way of the clutch mechanism and transmits the opening movement to the ratchet.

3. A vehicle door latch device according to claim 2, wherein said lock lever is so located in the vicinity of the ratchet lever that said lock lever is returned to the unlocked position by contact with the ratchet lever when the ratchet lever is displaced by the opening movement of the inside open handle while said lock lever is being in the locked position.

* * * * *